United States Patent [19]

James

[11] Patent Number: 4,591,205

[45] Date of Patent: May 27, 1986

[54] GLIDER RECLINER

[75] Inventor: Ronald O. James, Shelbyville, Ky.

[73] Assignee: Leggett & Platt, Incorporated, Carthage, Mo.

[21] Appl. No.: 548,706

[22] Filed: Nov. 4, 1983

[51] Int. Cl.[4] ..... A47C 1/038; A47D 13/10

[52] U.S. Cl. ..... 297/85; 108/132; 248/188.8; 297/281

[58] Field of Search ..... 297/16, 51, 68, 85, 297/273, 276, 281, 380; 248/188.8, 439, 677; 108/123, 126, 131, 132

[56] References Cited

U.S. PATENT DOCUMENTS

| | | | |
|---|---|---|---|
| 674,910 | 5/1901 | Dutton | 297/281 X |
| 2,044,862 | 6/1936 | Smith | 297/281 X |
| 2,271,440 | 1/1942 | Nelems | 297/281 |
| 2,283,000 | 5/1942 | Feldman | 297/273 X |
| 2,311,482 | 2/1943 | Smith | 297/282 X |
| 2,718,916 | 9/1955 | Borochoff | 297/287 |
| 3,047,334 | 7/1962 | Vanderminden | 297/281 X |
| 3,379,473 | 4/1968 | Mizelle | 297/85 X |
| 4,133,272 | 1/1979 | Naglowsky | 108/132 |

*Primary Examiner*—William E. Lyddane
*Assistant Examiner*—Peter R. Brown
*Attorney, Agent, or Firm*—Wood, Herron & Evans

[57] ABSTRACT

A glider recliner comprises a recliner linkage mounted atop a glider base adapted to mount the recliner linkage for forward and rearward gliding motion. The recliner linkage comprises a recliner seat link adapted to support a back rest and seat, a recliner base plate and recliner linkage mechanism connected between the recliner seat link and base plate and operable to effect movement of seat and back rest between upright and reclined positions. The recliner linkage also includes a leg rest assembly adapted to move between an extended and retracted position.

12 Claims, 4 Drawing Figures

FIGURE I

GLIDER RECLINER

FIELD OF THE INVENTION

This invention relates generally to glider chairs, and, more particularly, to a glider recliner.

BACKGROUND OF THE INVENTION

Standard recliner clairs generally comprise a fixed frame, a body support including a seat and seat back, a body support linkage assembly connecting the body support to the fixed frame and a leg rest assembly. The recliner is adapted to move between an upright position, and a reclining position where the chair seat and back are tilted rearwardly by operation of the body support linkage assembly and the leg rest assembly is extended parallel to the floor. Many variations in the operation of recliners have been made in recent years including the addition of a rocker base between the fixed frame and body support so as to provide a rocking motion of the recliner chair when in its upright position. However, the rocker base portion of rocker recliner chairs has, until recently, often produced a short, uncomfortable rocking motion. New rocker base designs for rocker recliners, such as disclosed in a co-pending application entitled "Rocker Recliner", assigned to the same assignee as this invention, have improved rocking motion of the recliner by providing a long, arcuate motion similar to that obtained in rocking chairs having a curved base support.

It is known that glider chairs also provide a relatively long arcuate swinging or gliding motion which is comfortable to many people. However, in the past, glider chairs have been primarily intended for use as informal furniture around the home such as on porches, decks, patios and like. Known glider chairs comprise an integral seat or chair assembly, and a supporting glider assembly, which are connected by linkages so that the chair may swing or glide in a forward and backward arcuate movement relative to the base by the foot action of a seated person or persons. Typically, the entire chair and glider assembly are connected and foldable as an integral unit, and neither the chair assembly nor the glider assembly are manufactured separately. As such, prior art glider chairs, and in particular the glider bases of such chairs, have been used in only limited applications such as for patio furniture and the like.

It is therefore an object of this invention to provide a glider recliner chair.

It is another object of this invention to provide a glider base assembly adapted to mount a recliner chair for forward and rearward gliding motion.

It is another object of this invention to provide a glider recliner having a separate recliner assembly and glider assembly, which are adapted to mount together to form a glider recliner chair.

SUMMARY OF THE INVENTION

These and other objects are accomplished in a glider recliner according to this invention which comprises a recliner chair assembly including a back rest and seat forming a recliner body support, a recliner seat link adapted to support the back rest and seat, a recliner base plate, recliner linkage connected between the recliner seat link and base plate and being operable to move the body support between an upright and reclined position, and a leg rest assembly connected to the recliner seat link and being movable between a retracted and extended position. The glider base comprises a glider assembly, adapted to mount to the recliner base plate, and a base assembly, which cooperate to move the recliner chair assembly in a forward and rearward gliding motion.

The base assembly of the glider base includes a pair of laterally spaced side panels and opposed front and rear base supports each pivotally mounted to the side panels. Locking means are provided for locking the base supports in an extended or support position relative to the side panels while the glider recliner is in use. The locking means may be released so that the front and rear base supports can be pivoted upwardly relative to the side panels to place the glider base in a more compact form for storage and shipment. The base assembly also includes stops adapted to engage a link of the recliner linkage so as to prevent gliding motion of the recliner assembly when in a reclined position.

The glider assembly of the glider base includes a pair of linkage assemblies each including a front and rear link pivotally mounted at one end to one of the side panels, and being movable relative to the side panels forwardly and rearwardly along a swinging or gliding path. The front and rear links of each linkage assembly are mounted at their opposite ends to one of a pair of opposed support plates, which are movable with the linkage assemblies along the gliding path. The opposed support plates are adapted to mount to the recliner base plate, which, in turn, supports the remainder of the recliner chair.

DESCRIPTION OF THE DRAWINGS

The structure, operation and advantages of this invention will become further apparent upon consideration of the following description taken in conjunction with the accompanying drawings wherein.

DETAILED DESCRIPTION OF THE INVENTION

Figure 1:
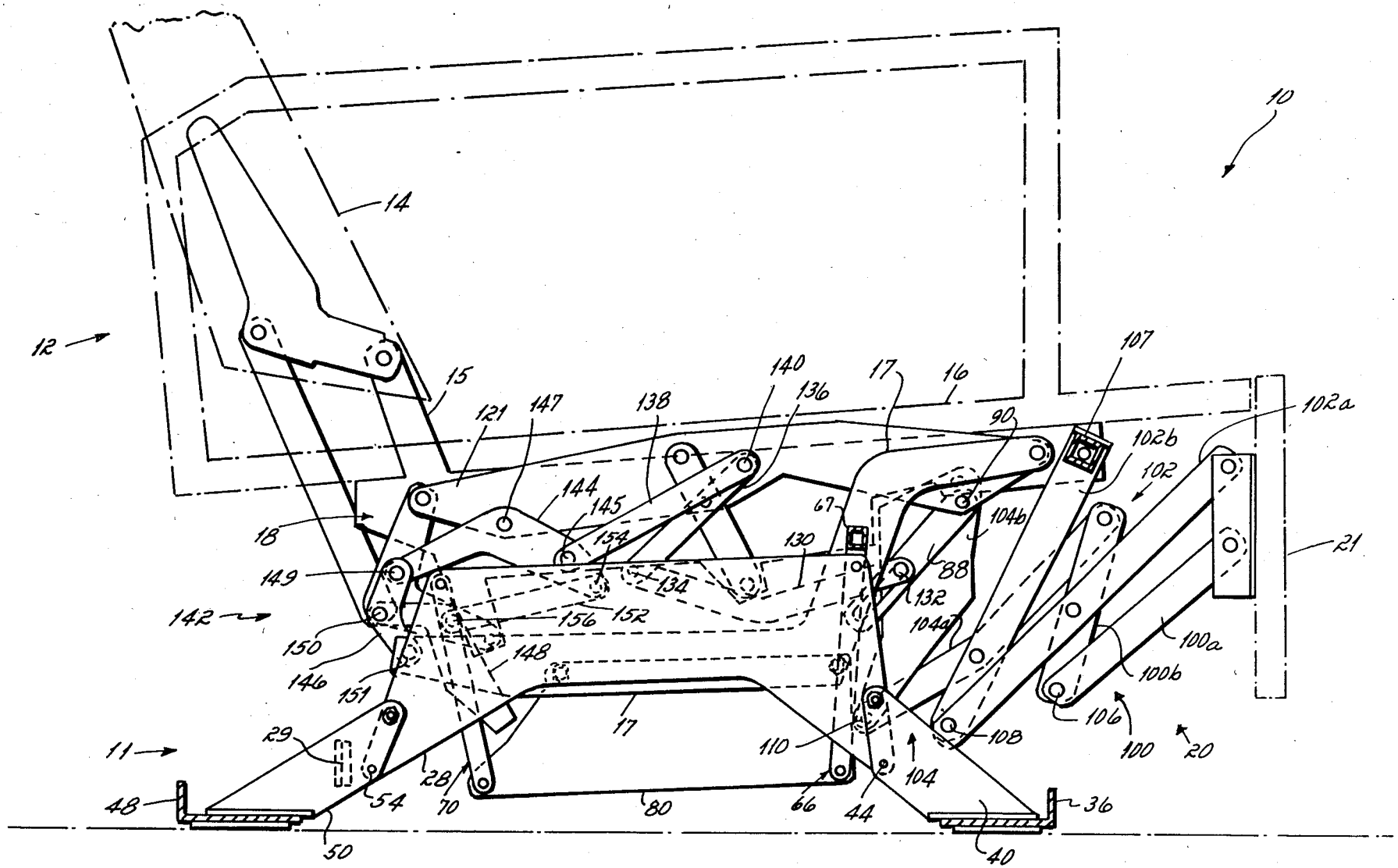
FIG. 1 is a side view of the glider recliner of this invention with the recliner in a retracted, upright position.

The glider recliner 10 of this invention comprises a glider base 11 adapted to mount a recliner chair assembly 12 having a back 14 and seat 16 forming a body support, a recliner seat link 15, a recliner base plate 17, a recliner linkage assembly 18 and a leg rest assembly 20. The glider base 11 includes a base assembly 24, and a glider assembly 26 movable forwardly and rearwardly relative to the base assembly 24 along a long, arcuate swinging or gliding path.

As illustrated in the drawings, one side of the base assembly 24 of glider base 11 is shown mounted to a portion of the recliner linkage 18 as discussed in detail below. Only that side of base assembly 24 shown in FIGS. 3 and 4 will be described herein, it being understood that the opposite laterally spaced side thereof is identical in structure and operation. The illustrated portion of base assembly 24 comprises an upright side panel 28 formed from steel plate or other high strength material, and opposed front and rear base supports 32, 34, only one side of which are shown in the drawings. Mounted to the rear portion of side panel 28 is a stop 29, for purposes to become apparent below. The front base support 32 includes a plate 36 extending perpendicularly to side panel 28 and having a pad (not shown) at either end for contacting the floor. A front leg 40 is mounted at one end to plate 36 and extends upwardly at approximately a 45° angle from plate 36 to the side panel 28, where it is pivotally connected thereto by a pin 44. Rear base support 34 is essentially identical to front base support 32, and includes a plate 48 having floor pad and a rear leg 50 connected at one end to the plate 48 and mounted by a pin 54 to the side panel 28.

Figure 3:
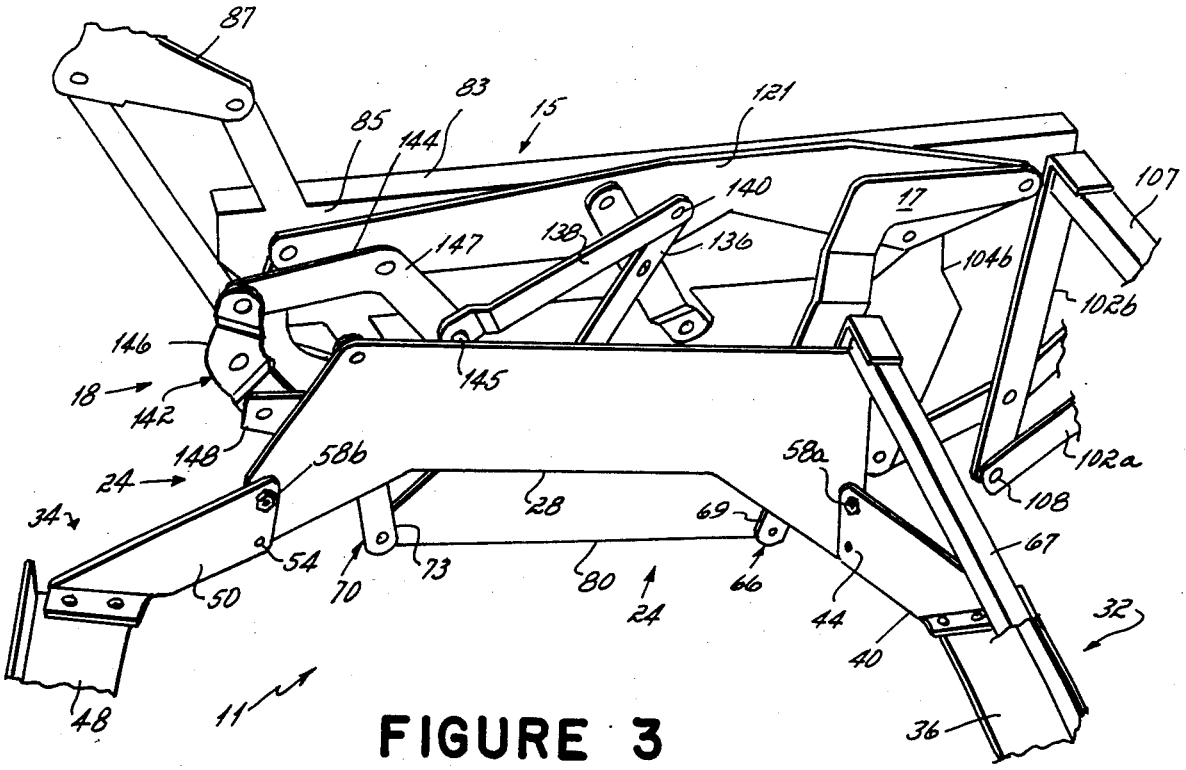
FIG. 3 is a partial isometric view of the glider base of this invention.

The front leg 40 of front support 32 and the rear leg 50 of rear support 34 are each movable about their pin connections to side panel 28 between an extended or support position in which their plates 36, 48, respectively, contact the floor or ground, and a retracted shipping position in which the front and rear supports 32, 34 are moved to a position adjacent the top of side panel 28. Aligning bores (not shown) are formed in the front and rear leg 40, 50 and side panel 28 through which bolts 58*a* and 58*b* are adapted to be inserted and held in place by nuts. The bolts 58*a,b* secure or lock the legs of front and rear supports 32, 34 rigidly in place relative to side panel 28 while the glider recliner 10 is in use. As shown in FIG. 3, front and rear support 32, 34 extend appreciably beyond the end of side panel 28 in their extended or operating position. This provides the necessary stability for the operation of glider recliner 10, but also increases the length of glider base 11 significantly making shipment relatively awkward and costly.

Figure 4:
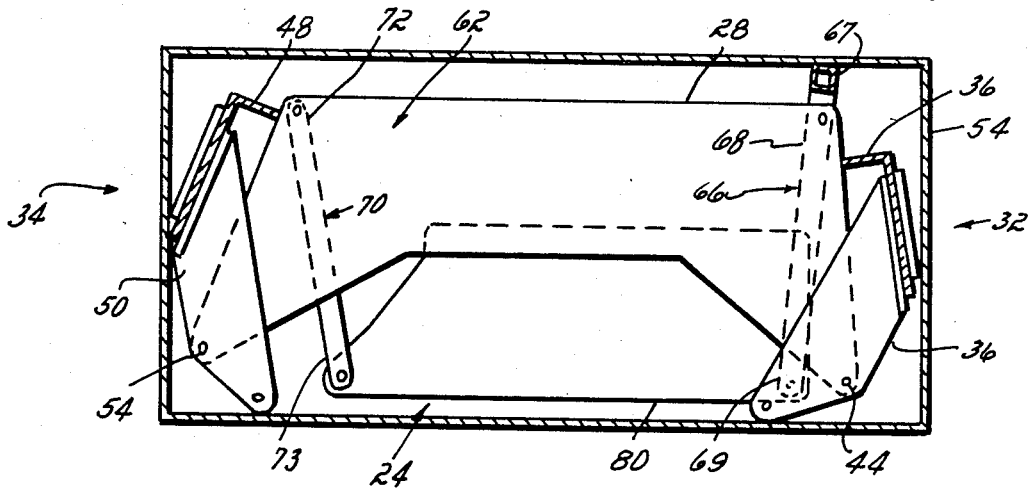
FIG. 4 is a side view of the glider base shown in FIG. 3 in a retracted position for shipping in a crate.

In order to reduce the overall length of glider base 11, for easier packing and shipment, bolts 58*a,b* are adapted to be removed from front and rear supports 32, 34, freeing them to pivot upwardly about their pin connections to side panel 28. With the front and rear supports 32, 34 folded upwardly along the top of side panel 28, the glider base 11 is in a compact position for shipping within a crate 54 such as shown in FIG. 4. After shipment, the front and rear base supports 32, 34 are pivotal back to their extended, support position and secured or locked in place by reinserting the bolts 58*a,b* between the supports 32, 34 and side panel 28, and then tightening the nuts in preparation for use of the glider recliner 10.

As with base assembly 26, only one side of the glider assembly 26 is illustrated in the drawings, it being understood that the laterally spaced opposite side of glider assembly 24 is identical in structure and operation. The glider assembly 26 comprises a linkage assembly 62 mounted to side panel 28. Linkage assembly 62 includes a front link 66 pivotally mounted at its upper end 68 near the front of side panel 28, and a rear link 70 pivotally mounted at its upper end 72 near the rear of side panel 28. Both the front and rear links 66, 70 extend downwardly from their connection to side panel 28 at a slight angle toward one another, and are pivotally mounted at their lower ends 69, 73, respectively, to a glider support bar 80. The links 66, 70, and glider support bar 80 of linkage assembly 62 move an a unit forwardly and rearwardly relative to the fixed side panel 28 along a glide path discussed in more detail below. A cross brace 67 extends between and mounts to the front links 66 of glider assembly 26 for enhanced lateral stability and to assure unitary forward and rearward gliding mounting of the links 66, 70 and support bars 80. The recliner base plate 17 of recliner chair assembly 12 mounts to support bar 80, in a manner described below, for unitary movement therewith in a forward and rearward gliding motion.

As mentioned above, recliner chair assembly 12 includes a recliner linkage 18 and a leg rest assembly 20. The recliner linkage 18 and leg rest assembly 20 both include a series of interconnected links disposed on opposite sides of the recliner chair assembly 12. The recliner linkages 18 are adapted to move the recliner chair assembly 12 between an upright and reclined position, and the leg rest assembly 20 moves a leg rest 21 between a retracted position and an extended position in which the leg rest 21 is substantially parallel to the floor. For purposes of the present discussion, only the links on one side of recliner chair assembly 12 will be described, it being understood that the links of both the recliner linkage 18 and leg rest assembly 20 on the opposite side of the recliner chair assembly 12 are substantially identical in structure and operation.

The recliner chair assembly 12 includes a recliner seat link 15 having a generally horizontally extending leg 83 connected to a vertical leg 85. The horizontal leg 83 is formed with spaced bores (not shown) adapted to receive bolts for mounting the seat 16. A seat back support 87 is mounted to the rear portion of recliner seat link 15, which is adapted to mount the back rest 14 by conventional means.

Figure 2:
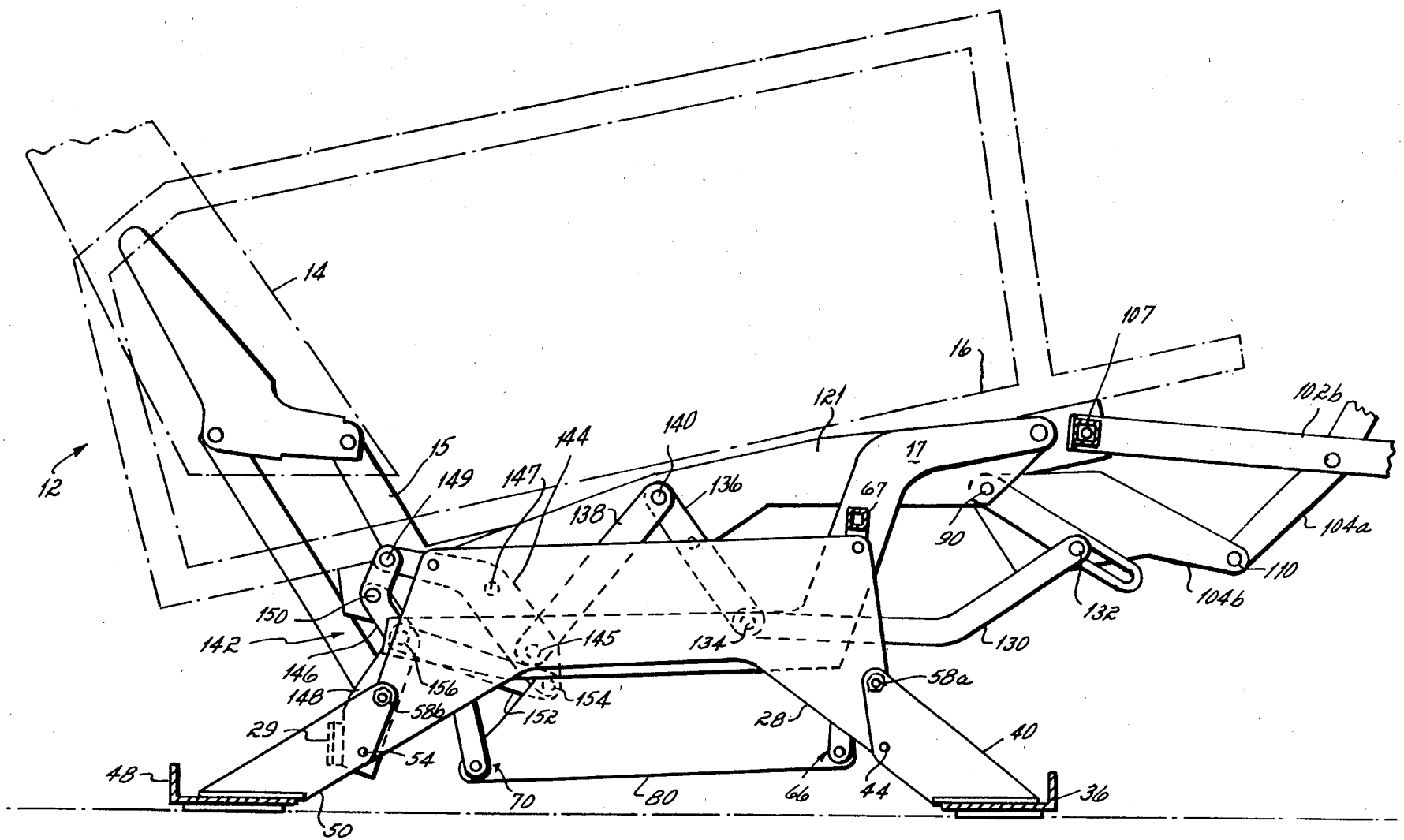
FIG. 2 is a side view of the glider recliner herein in a reclined position.

The leg rest assembly 20 and recliner linkage 18 are generally of conventional construction, with some minor modifications explained in detail below. Referring to FIGS. 1 and 2, a primary actuating link 88 is connected by a pin 90 to the recliner seat link 15 and extends downwardly into driving engagement with a link 104*b* of the leg rest assembly 20 and a drive link 130 of recliner linkage 18. In response to a forward or rearward shifting of weight of a person seated in the glider recliner 10, or, alternately, in response to release by a control handle (not shown) the primary actuating link 88 is operable to initiate movement of the leg rest assembly 20 between a retracted and extended position, and of the recliner linkage 18 between an upright and reclined position.

As shown in FIGS. 1 and 2, the leg rest assembly 20 is in the form of a triple V lazy tong linkage of conventional overlap type. The arms 100*a*, 100*b*, and 102*a*, 102*b*, and 104*a*, 104*b* of each link pair 100, 102, and 104 in the triple V lazy tong linkage are pivotally connected at adjacent ends as at points 106, 108, and 110 respectively. A cross brace 107 is mounted to arm 102*b* and extends to the opposite side of leg rest assembly 20 to provide lateral stability. Additional structural details and the operation of the triple V lazy tong linkage are known in the art, and are described in detail in U.S. Pat. No. 4,113,305.

One end of the link arm 104*b* is pivotally connected to the primary actuating link 88. In response to motion of the primary actuating link 88, as, for example, if a person seated in the glider recliner 10 moved rearwardly, the lazy tong linkages undergo a scissors-type movement in extending from a retracted position to an extended position in which the leg rest 21 is substantially parallel to the floor. The reverse motion occurs when the person seated shifts his weight forwardly and the linkages retract.

The recliner linkage 18 is also actuated by the primary actuating link 88 in response to weight shift on the seat 16 and back 18, or, alternately, by operation of a control lever (not shown). The recliner linkage 18 includes a linkage mounting plate 121 which is disposed generally parallel to the recliner seat link 15 and connected thereto by fixed front, intermediate and rear linkages (not shown). The recliner base plate 17 is suspended from the linkage mounting plate 121 and bolted or otherwise suitably fixed to the glider support bar 80 of the glider assembly 26. Therefore, gliding motion of the glider base 10 is transmitted by the glider assembly 26 through the recliner base plate 17 and linkage mounting plate 121, to the recliner seat link 15 which supports the back rest 14 and seat 16.

The recliner linkage 18 further includes a series of links adapted to move the back rest 14 and seat 16 between an upright and reclined position. A drive link 130 is connected at one end by pin 132 to the primary actuating link 88, and at the other end by a pin 134 to an intermediate connector link 136. A second intermediate connector link 138 is pinned as at 140 to the first intermediate connector link 136, and connects at its opposite end to an end linkage 142. The end linkage 142 comprises the following elements: a first V-shaped link 144 pinned as at 145 to the free end of second intermediate connector link 138 and at its midpoint 147 to the linkage mounting plate 121; a second V-shaped link 146 pinned at one end 149 to the free end of first V-shaped link 144 and at the other end 151 to the recliner base plate 17; a stop or snub link 148 pinned as at 150 to the second V-shaped link 146; and, an end driver link 152 pinned as at 154 to the first V-shaped link 144 and at 156 to the snub link 148.

In response to rearward shifting of one's weight in seat 16, or alternately by operation of a recliner linkage control lever (not shown), the primary actuating link 88 move forwardly relative to the seat 16 and back rest 14. As discussed above, this forward motion of primary actuating link 88 drives the link arm **104*b* of leg rest assembly 20** forwardly causing the triple V lazy tong linkage thereof to scissor outwardly to an extended position substantially parallel to the floor.

Forward movement of the primary actuating link 88 also moves the drive link 130 of recliner linkage 18 forwardly, which, in turn, moves the intermediate connector links 136, 138 from a generally upright position where they cross one another as shown in FIG. 1, to an extended position wherein the second intermediate connector link 138 pivots downwardly toward the floor as shown in FIG. 2. In moving downwardly, the second intermediate connector link 138 moves the first V-shaped link 144 both downwardly and pivotally so that its end connected at point 145 to second intermediate link 138 is lower than its opposite end connected at point 149 to the second V-shaped link 146.

The movement of first V-shaped link 144 accomplishes two functions. First, the overall downward movement of first V-shaped link 144 urges the rear portion of seat 16 and back rest 14 downwardly since first V-shaped link 144 is pinned at its midpoint 147 to the linkage mounting plate 121, which, in turn, is mounted to the recliner seat link 15. Secondly, the pivotal movement of the first V-shaped link 144 causes the second V-shaped link 146 to move upwardly and the end driver link 152 to pivot. The second V-shaped link 144, pinned as at 150 to the upper end of snub link 148, pivots such upper end about the pin connection 156 of snub link 148 with end drive link 152. As the upper end of snub link 148 pivots upwardly, its lower end moves downwardly into engagement with the stop 29 mounted to the side panel 28 of glider base assembly 24. See FIG. 2. Therefore, with the recliner chair assembly 12 in a reclined position, the snub link 148 contacts the stop 29 so as to lock the recliner chair assembly 12 and prevent further gliding motion. Reverse motion of the recliner linkage 18 causes the lower end of snub link 148 to pivot upwardly, out of engagement with stop 29, to permit gliding motion of the recliner chair assembly 12 in its upright position.

The preferred long, arcuate gliding motion of the rocker recliner 10 is achieved by the configuration of linkage assembly 62 in glider base 11. As shown in FIGS. 3 and 4, the front link 66 of linkage assembly 62 extends downwardly from the side panel 28 to the glider support bar 80 in a rearward direction so that the upper end 68 of front link 66 is nearer the front portion of glider support bar 80 than its lower 69. In addition, the rear link 70 extends diagonally toward the front of glider base 11 with its upper end 72 being mounted toward the rear portion of glider support bar 80 and its lower end 73 extending toward the front thereof. This angled orientation of the front and rear links 66, 70 of linkage assembly 62 imparts a distinctive motion to the recliner seat 16. Movement of the recliner seat 16 to a rearward position causes the front part 15 of the seat 16 to tilt upwardly relative to the seat back 14, while during a forward gliding motion the seat 16 remains essentially horizontal relative to the ground with the front part of the seat 16 tilted only slightly downwardly. The linkage assembly 62, together with the linkage assembly on the opposite side of glider assembly 26 (not shown) provide a comfortable, long gliding motion with the seat 16 of recliner chair assembly 12 tilting in a manner to help the user remain securely seated during an entire gliding motion.

While the invention has been described with reference to a preferred embodiment, it will be understood by those skilled in the art that various changes may be made and equivalents may be substituted for the elements thereof without departing from the scope of the invention. In addition, many modifications may be made to adapt a particular situation or material to the teachings of the invention without departing from the essential scope thereof. Therefore, it is intended that the invention not be limited to the particular embodiment as the best mode contemplated for carrying out this invention, but that the invention will include all embodiments falling within the scope of the appended claims.

I claim:

1. A glider recliner comprising:

a body support including a back rest and a seat;

opposed recliner seat links adapted to support said body support;

a leg rest assembly pivotally connected to said recliner seat links, said leg rest assembly including leg rest linkage means operable to move a leg rest between a retracted position and an extended position;

recliner linkage means connected to each of said recliner seat links for moving said body support from an upright to a reclined position, a recliner base plate connected to said recliner linkage means, said recliner linkage means being operable to lower the rear of said seat and move it closer to said recliner base plate than the front of said seat while simultaneously effecting extension of said leg rest from retracted to extended position, said recliner linkage means including a series of pivotally interconnected links operable to move said body support between an upright position and a reclined position;

a glider base including a base assembly and a glider linkage assembly pivotally suspended from each side of said base assembly, said glider linkage assembly being movable forwardly and rearwardly relative to said base assembly along a gliding path; and each of said recliner base plates being connected to one of said glider linkage assemblies for movement therewith along said gliding path.

2. A glider recliner as in claim 1 in which said base assembly comprises:

laterally spaced side panels; and opposed front and rear supports each pivotally mounted to said side panels.

3. A glider recliner as in claim 2 in which said front and rear base supports each comprise a plate extending perpendicularly to said side panels and a pair of laterally spaced legs extending between and mounted to said plate and one of said side panels, each said legs being pivotally mounted to said side panels.

4. A glider recliner as in claim 2 further including means for locking said front and rear supports to said side panels.

5. A glider recliner as in claim 4 in which said locking means comprises a bolt removably mounted between said front and rear supports and said side panels, said bolt being adapted to be tightened in place for securing said front and rear base supports in a support position to each said side panel, and said bolt being adapted to be removed to permit said front and rear base supports to pivot upwardly relative to said side panels to a retracted, shipping position.

6. The glider recliner of claim 1 wherein said glider base further includes:

laterally spaced side panels;

opposed front and rear base supports each pivotally mounted to said side panels;

said opposed glider linkage assemblies each being pivotally mounted to one of said side panels and being movable relative thereto along a gliding path;

each of said recliner base plates being adapted to be connected to one of said glider linkage assemblies for movement therewith along said gliding path.

7. A glider recliner as in claim 6 in which said glider linkage assembly each include a front link pivotally mounted at its upper end adjacent the front of one of said side panels, said front link extending downwardly in a rearward direction and being pivotally connected at its lower end to one of said recliner base plates; and a rear link pivotally mounted at its upper end adjacent the rear of one of said side panels, said rear link extending downwardly in a forward direction and being pivotally connected at its lower end to one of said recliner base plates.

8. A glider recliner as in claim 6 in which at least one cross brace extends between and mounts to said side panels for lateral stability of said glider base.

9. The glider recliner of claim 6 further including locking means for preventing movement of said body support along said gliding path with said body support disposed in a reclined position.

10. A glider recliner as in claim 9 in which said locking means comprises a pair of stops each mounted to one of said side panels, and a pair of snub links forming a portion of said recliner linkage, said snub links being adapted to pivot into engagement with said stops with said backrest and seat in a reclined position to prevent gliding motion thereof.

11. A glider recliner as in claim 1 in which said recliner linkage means each include means for locking said body support to prevent gliding motion with said body support in a reclined position.

12. A glider recliner as in claim 11 further including stops mounted to said base assembly, said locking means comprising a snub link pivotally connected to a V-shaped link and an end driver link of said recliner linkage means, said V-shaped link and end driver link being adapted to pivot said snub link between a locking position in which snub link engages said stops for preventing movement of said body support, and an unlocked position in which said snub link disengages said stops.

* * * * *